United States Patent [19]

Kemmel

[11] 4,432,297

[45] Feb. 21, 1984

[54] LOW THREAD SUPPLY MONITOR IN A SEWING MACHINE

[75] Inventor: Patrice J. Kemmel, Stutensee, Fed. Rep. of Germany

[73] Assignee: Pfaff Haushalmaschinen GmbH, Fed. Rep. of Germany

[21] Appl. No.: 254,781

[22] Filed: Apr. 16, 1981

[30] Foreign Application Priority Data

Apr. 17, 1980 [DE] Fed. Rep. of Germany ..... 3014753

[51] Int. Cl.[3] ..... D05B 45/00; D05B 69/36

[52] U.S. Cl. ..... 112/278

[58] Field of Search ..... 112/278, 273; 250/561, 250/571; 139/273 A

[56] References Cited

U.S. PATENT DOCUMENTS 4,163,158 7/1979 Coughenour et al. ..... 250/561
4,195,292 3/1980 Puhich ..... 112/278 X
4,237,807 12/1980 Meier et al. ..... 112/278

*Primary Examiner*—Peter P. Nerbun
*Attorney, Agent, or Firm*—McGlew and Tuttle

[57] ABSTRACT

A monitoring device for monitoring a low thread supply in a sewing machine comprises a light emitter and light receiver positioned on opposite ends of a rotary hook in the sewing machine. The sewing machine is equipped with the rotary hook, a bobbin case, a bobbin in the bobbin case for carrying the thread and a drive shaft for rotating the rotary hook or which rotates as a function of rotation of the rotary hook. A pulse transmitter is connected to the drive shaft which supplies pulses to a control circuit connected to the light emitter. The control circuit, responsive to the pulses, activates the light emitter only during intervals at which apertures in the rotary hook, the case and the bobbin are aligned. Light passing through the aligned apertures indicates whether there is a low supply of thread on the bobbin.

14 Claims, 4 Drawing Figures

LOW THREAD SUPPLY MONITOR IN A SEWING MACHINE

FIELD AND BACKGROUND OF THE INVENTION

The present invention relates in general to sewing machines and in particular to a new and useful monitor for indicating a low supply of thread in the sewing machine.

Devices are known for monitoring the supply of thread in a sewing machine equipped with a rotary hook for lock stitching, a light emitter which delivers light pulses to a light receiver. The light from the light emitter passes through apertures which are provided in the body of the rotary hook, the bobbin case, and the bobbin.

Such devices require a strong source of light, since the apertures in the bobbin and the hook body, provided for optically sensing low thread supply, are aligned with each other only for a very short period of time, especially at high sewing speeds, and the thread supply can be sensed only during this alignment. The time interval available for measuring the remaining thread supply is therefore extremely short and depends on the speed of the rotary hook and of the bobbin carrying the thread.

Phototransistors are always responsive to light incidence with a delay, due to their intrinsic properties. If the light pulse is shorter than the delay time, reduced signal amplitudes are obtained. The delay time becomes shorter with increasing intensity of the light. The light emitting diode employed as a source of light must therefore be operated at the limit of its loading capacity. In addition, with a relatively high current consumption, ample space is needed for the transformer furnishing the current so that the small space available in the sewing machine is still further reduced.

SUMMARY OF THE INVENTION

The invention is directed to obtaining a substantial reduction of the power loss of the light emitter, to obtain a long life and at the same time a high luminous efficiency of the light emitter.

Accordingly, an object of the invention is to provide a device for monitoring low thread supply in a sewing machine equipped with a rotary hook for lock stitching, a light emitter for delivering light pulses and a light receiver for receiving the light pulses through apertures which are provided in the body of the rotary hook, a bobbin case and the bobbin, comprising, a pulse transmitter which is known per se, the pulse transmitter being responsive to at least one particular position of a drive shaft of the sewing machine, and the pulse transmitter controlling the operating frequency and the operating time of the light emitter through a control device.

Due to the inventive design, the light emitter is considerably relieved of load, and is caused to emit only very short light pulses of high intensity, in proportion to the speed of the rotary hook, thus solely within the time periods during which a reception is possible.

The power loss of the light emitter is further reduced by providing a pulse counter between the control device of the light emitter and the pulse transmitter. This is so, with the plurality of thread turns in juxtaposition in one layer of a wound bobbin, the monitoring operation is not needed at every revolution of the hook to obtain an indication of the end of a thread supply in time.

Another object of the invention is to provide such a monitoring device wherein the light receiver is connected to operate in synchronism with the light emitter, the operating time of the light receiver being a function of the operating time of the light emitter. According to another object of the invention the light receiver is connected to an operating circuit for the light emitter through a delay line or delay means. Interfering pulses which would affect a secure reception by the light receiver are thus eliminated to a large extent.

A switching off of the light emitter after detecting that no thread remains on the bobbin, thus that the light emitting operation is no longer needed, is obtained, in a sewing machine equipped with an element indicating the end of the under-thread. Thus, according to another object of the invention, any control device for the light emitter, actuates a switching element for an indicating light or device, the switching element being coupled to parts of the circuit for switching the light emitter off.

In cases where the drive of the sewing machine is controlled by a microcomputer, the microcomputer can be used in a particularly advantageous, cost saving way as a device for controlling the light emitter and the light receiver.

Another object of the invention is to provide a monitoring device for indicating a low supply of thread in a sewing machine which is simple in design, rugged in construction and economical to manufacture.

The various features of novelty which characterize the invention are pointed out with particularity in the claims annexed to and forming a part of this disclosure. For a better understanding of the invention, its operating advantages and specific objects attained by its uses, reference is made to the accompanying drawings and descriptive matter in which preferred embodiments of the invention are illustrated.

DESCRIPTION OF THE PREFERRED EMBODIMENTS

Turning to the drawings in particular, the invention embodied therein comprises a monitoring device for monitoring and indicating a low supply of thread in a sewing machine which utilizes light transmitting and light receiving elements on opposite sides of a bobbin, which are activated only at selected intervals during which apertures in the bobbin are appropriately aligned. This effectively reduces load requirements of the light transmitting element.

Figure 1:
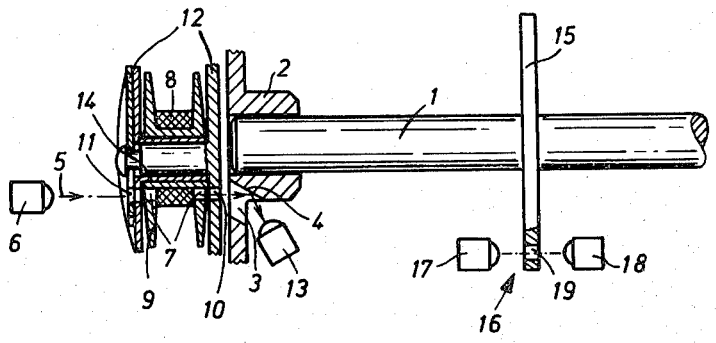
FIG. 1 is a partial, and partly sectional view of a rotary hook drive of a sewing machine.

The hook drive shown in FIG. 1 comprises a drive shaft 1 driven by a main shaft (not shown) and carrying a hook body 2 secured thereto and shown only partly. Hook body 2 is provided with an opening 3 extending obliquely to the axis of the hook body and having its boundary surface portion nearest to the hook body axis finished as a reflection surface 4 for a light beam 5. The light beam issues from a light emitter 6, passes through bores 7 provided in a bobbin 9 wound with a thread 8, and through bores 10 and 11 provided in the bobbin case 12, to fall on reflecting surface 4 at which it is reflected to a light receiver 13. Bobbin case 12 is accommodated in the hook body 2 in a manner known per se (not shown) and has a center pin 14 carrying bobbin 9.

With the sewing machine in operation, the bobbin case 12 stands still while hook body 2 is rotated. Bobbin 9 also rotates during the sewing operation, due to the continuing withdrawal of thread 8, only at a very low speed. The position of bores 10, 11 of bobbin case 12 relative to the axis of light beam 5 passing from emitter 6 to receiver 13 does not change, while reflection surface 4 and bores 7 of bobbin 9 allow the passage of light beam 5 only from time to time.

A pulse transmitter disc 15 of a pulse transmitter 16 is secured to drive shaft 1. Transmitter disc 15 has an aperture 19 cooperating with a light emitting diode 17 and a phototransistor 18.

Figure 2:
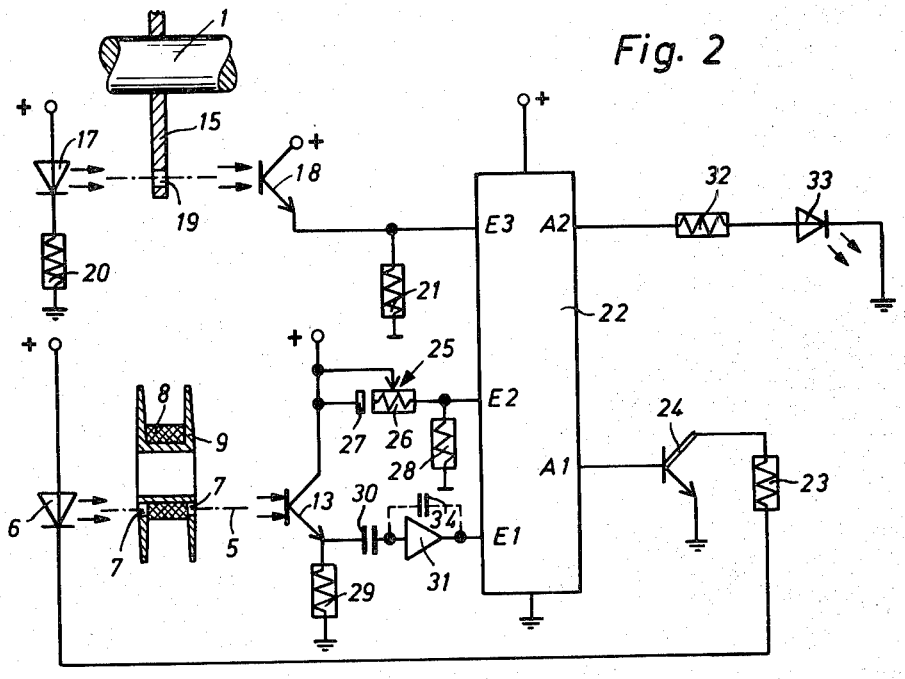
FIG. 2 is a simplified diagram of a circuit for controlling the thread monitor.

FIG. 2 shows a simplified circuit diagram with the component parts which are necessary for electrically controlling the operation of the thread monitor. From the positive pole of a controlled voltage source, the current flows through light emitting diode 17 and a resistor 20 to frame or ground. Light emitting diode 17 is disposed on one side of transmitter disc 15 while phototransistor 18 is secured to the other side thereof. The collector of phototransistor 18 is connected to the positive pole and the emitter is connected through a resistor 21 to frame. The connecting line between phototransistor 18 and resistor 21 is connected to an input E3 of microcomputer 22.

Again from the positive pole, the current flows through a light emitter 6 designed as a light emitting diode, a resistor 23, and a Darlington transistor 24 to frame. The base of the Darlington transistor 24 is connected to an output A1 of microcomputer 22. The current also flows from the positive pole of the voltage source through a starting resistor 25 to an input E2 of microcomputer 22. Starting resistor 25 comprises a resistor body 26 and a cutoff segment 27 for final disconnection, and forms a part of a voltage divider. It serves to produce a reference voltage at input E2 of microcomputer 22. For this purpose a grounded resistor 28 is connected to input E2.

The current also flows from the positive pole through a light receiver 13 comprising a phototransistor, and a resistor 29 to frame. A capacitor 30 is connected to the emitter of phototransistor 13 and, through an amplifier 31, to an input E1 of microcomputer 22. Another line leads from an output A2 of microcomputer 22 through a resistor 32 and a light emitting diode 33 serving as an indicating element.

The arrangement operates as follows:

During operation of the sewing machine, the light beam issuing from light emitter 17 passes, during a very short portion of time, through the aperture 19 of rotating transmitter disc 15, when it is in its aligned position, and causes phototransistor 18 to respond, so that a voltage builds up momentarily across resistor 21, which is applied, as a pulse, to input E3 of microcomputer 22. Each pulse causes a program interruption in the microcomputer. Input E3 of microcomputer 22, however, may also be connected to an internal pulse counter causing a program interruption only after reaching a certain count, and then resetting automatically. Such a pulse counter can be within the microcomputer 22.

Figure 3:
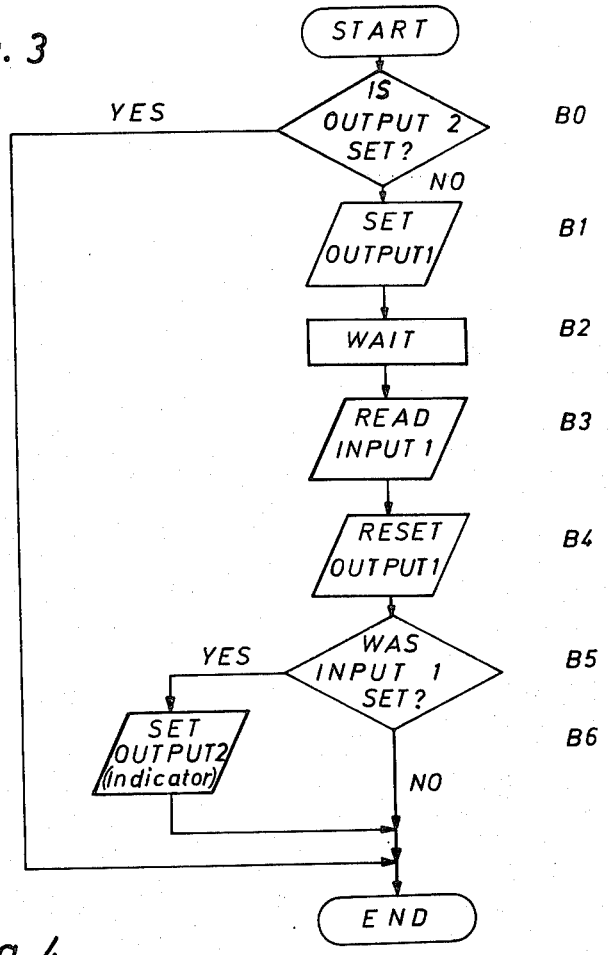
FIG. 3 is a flowchart showing individual steps of the subroutine stored in the microcomputer.
Figure 4:
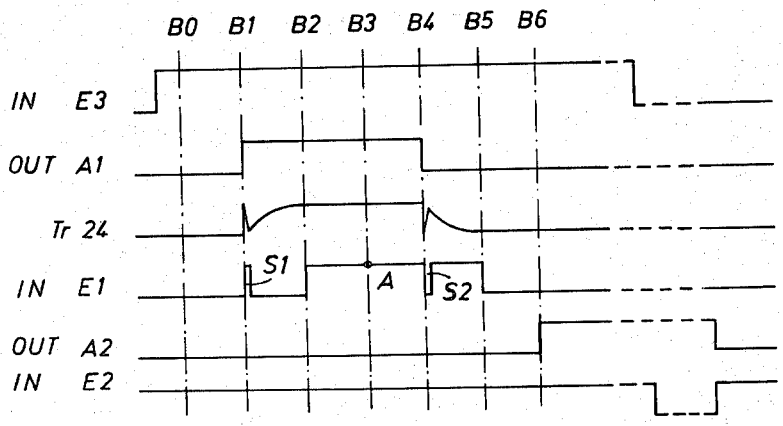
FIG. 4 shows the voltage levels at the microcomputer inputs and outputs associated with the control of the thread monitor.

Upon the interruption, a subroutine is started which is shown as a flowchart in FIG. 3. The voltage levels at the inputs and outputs of microcomputer 22, corresponding to the program interruptions, and the voltage variation at light receiver 13, are shown in FIG. 4.

In this subroutine, the first instruction B0 is for testing whether output A2 of microcomputer 22 is set. If set, a jump occurs to the end of the subroutine, and light emitter 6 remains currentless. With output A2 set, the current flows through light emitting diode 33 to frame or ground and diode 33 flashes to indicate the end of the thread supply. During the flashing, light emitter 6 is off and thus without load.

If output A2 of microcomputer 22 is not set, an instruction B1 is given to set output A1 of microcomputer 22. This enables Darlington transistor 24 and a full-load current flows through light emitter 6 causing it to momentarily emit a high-intensity light beam. The next instruction B2 is "wait", to compensate for the delay time of light receiver 13 and also to allow any switch-on disturbances S1 (FIG. 4) which may occur while connecting light receiver 13, to decay.

As soon as thread 8 of bobbin 9 is withdrawn to such an extent that light beam 5 can at least partly pass through bores 7 in bobbin 9 and bores 10, 11 in bobbin case 12, the light beam is deflected at reflection surface 4 in hook body 2, to light receiver 13. In consequence, receiver 13 becomes conductive and current flows through resistor 29 to frame. The voltage thus reduced is applied through capacitor 30 and amplifer 31 to input E1 of microcomputer 22. Advantageously, capacitor 30 is used for filtering out DC currents caused by daylight and low-frequency AC currents caused by the sewing light.

Instruction B3 is an interrogation of input E1 of microcomputer 22 at a point of time A (FIG. 4) at which the current flow in light receiver 13, upon a response thereof, has stabilized. This eliminates picking up, during the interrogation of switch-on-and switch-off, disturbances S1 and S2 at input B1 caused by light emitter 6, and other possible disturbances which might occur during the extremely short interrogation time of about 1/500 of the revolution period of the hook at the highest sewing speed.

An instruction B4 then resets output A1 of microcomputer 22 so that the current through darlington transistor 24 is interrupted and does not flow through light emitter 6.

A second test is then made following an instruction B5. This is to interrogate whether input E1 of microcomputer 22 was set during the preceding "read" instruction B3. If true, output A2 of microcomputer 22 is set, whereupon current flows through resistor 32 and light emitting diode 33 to frame. Light emitting diode 33 indicates the end of thread supply on bobbin 9.

Now the end of the subroutine is reached and a jump occurs to the main program, which is also the case if the answer was "no".

To switch light emitting diode 33 off after inserting a new bobbin 9, the actuation of starting resistor 25 at the restart of the sewing machine is utilized. Prior to exchanging bobbin 9, the machine must be stopped by disconnecting starting resistor 25 whose slider is thereby shifted to cut-off segment 27, so that the voltage at input E2 of microcomputer 22 drops to zero. To start the sewing machine, starting resistor 25 is actuated.

The slider then shifts from cutoff segment 27 back to resistor body 26 and, across resistor 28, a reference voltage builds up at input E2 of microcomputer 22. The switching voltage pulse resets the input A2 of microcomputer 22 whereby light emitting diode 33 is switched off.

It is also possible to program the microcomputer 22 in such a way that instructions B3 and B4 are interchanged, i.e., first output A1 is reset and next input E1 is read. The test of whether input E1 is set follows. In this case, however, the information must be held at the output of amplifier 31 for a sufficient time, by means of a capacitor 34 connected in parallel to the amplifier.

To avoid reactive effects of the high pulse load of light emitter 6 on the control member for the supply voltage, light emitter 6 may be connected in addition to an uncontrolled voltage source. Resistor 23 is then advantageously provided in the emitter branch of transistor 24, to connect the transistor as a source of constant current.

The pulse transmitter 16 of course may be also provided on another shaft running in synchronism with drive shaft 1, for example, on the main shaft. In such a case, the control operations are reduced to one half in sewing machines equipped with lockstitch rotary hooks, where the hook revolves twice per main shaft revolution.

While specific embodiments of the invention have been shown and described in detail to illustrate the application of the principles of the invention, it will be understood that the invention may be embodied otherwise without departing from such principles.

What is claimed is:

1. A device for monitoring low thread supply in a sewing machine equipped with a rotary hook for lockstitching and a light emitter delivering light pulses to a light receiver through apertures which are provided in the body of the rotary hook, the bobbin case and the bobbin, comprising, a pulse generator connected to and controlling the light emitter, and a pulse transmitter connected to said pulse generator and responsive to at least one definite position of a drive shaft of the sewing machine for controlling operating time of the light emitter.

2. A monitoring device according to claim 1, wherein the light receiver is connected to operate in synchronism with the light emitter and the operating time of the light receiver is a function of the operating time of the light emitter.

3. A monitoring device according to claim 2, wherein the light receiver is connected to an operating circuit of the light emitter in the pulse generator, through a delay time.

4. A monitoring device according to claim 1 wherein the pulse generator actuates a switching element for an indicating element, the switching element being coupled to an element for switching the light emitter off.

5. A device for monitoring low thread supply in a sewing machine equipped with a rotary hook for lockstitching and a light emitter delivering light pulses to a light receiver through apertures which are provided in the body of the rotary hook, the bobbin case, and the bobbin, comprising, a pulse transmitter responsive to at least one definite position of a drive shaft of the sewing machine, the pulse transmitter controlling the operating frequency and operating time of the light emitter through a control device, the control device for the light emitter being connected to the pulse transmitter through a pulse counter.

6. A device for monitoring low thread supply in a sewing machine equipped with a rotary hook for lockstitching and a light emitter delivering light pulses to a light receiver through apertures which are provided in the body of the rotary hook, the bobbin case, and the bobbin, comprising, a pulse transmitter responsive to at least one definite position of a drive shaft for the sewing machine, the pulse transmitter controlling the operating frequency and operating time of the light emitter through a control device, the sewing machine having a drive which is controlled by a microcomputer, and wherein the pulse transmitter triggers the microcomputer to start a subroutine for operating the light emitter and the light receiver.

7. A monitoring device according to claim 6, wherein the light receiver comprises a phototransistor whose collector-emitter section is connected through a capacitor and an amplifier to an input of the microcomputer and wherein the light emitter comprises a light emitting diode which is connected in the collector or emitter branch of a transistor having its base connected to an output of the microcomputer.

8. In a sewing machine, a monitor according to claim 7, wherein said pulse generator includes a microcomputer, said microcomputer having a pulse counter connected to said pulse transmitter for activating said light emitter after a selected number of said pulses.

9. In a sewing machine having a rotary hook for lockstitching, a bobbin case for a bobbin, a bobbin in the case for carrying thread, and a rotary shaft rotatable with or as a function of rotation of the rotary hook, the hook case and bobbin having alignable apertures aligned during an alignment interval to form a light passage; a low thread monitor comprising:

a light emitter on one side of the rotary hook, bobbin case and bobbin, activatable to shine light through the light passage;

a light receiver on an opposite side of the rotary hook, bobbin case and bobbin, for receiving light of said light emitter;

control means comprising a pulse generator connected to said light emitter for activating said light emitter at selective times; and a pulse transmitter connected to the rotary shaft, said light emitter and said pulse generator for generating pulses of light corresponding to the alignment intervals, said pulse generator responsive to the pulses to activate said light emitter during the alignment intervals.

10. In a sewing machine, a monitor according to claim 9, wherein said pulse transmitter comprises a disc connected to said rotary shaft having an opening therein, a second light transmitter on one side of said disc and a second light receiver on an opposite side of said disc, said disc opening movable between said second light emitter and receiver for generating said pulses.

11. In a sewing machine, a monitor according to claim 9, including a microcomputer having a first input connected to said light receiver for receiving a signal when light passes through the light passage defined by the aligned apertures, light passing through said light passage when a low supply of thread is carried on the bobbin; a second input connected to a reference source; a third input connected to said pulse transmitter for receiving said pulses; a first output connected to said light emitter for activating said light emitter; and a second output connected to indicator means for indicating a low supply of thread on the bobbin.

12. In a sewing machine, a monitor according to claim 11, including delay means between said light receiver and said first input of said microcomputer, said light receiver comprising a phototransistor.

13. In a sewing machine, a monitor according to claim 12, wherein said delay means comprises a capacitor connected to an emitter of said phototransistor and including an amplifer connected between said capacitor and said first input of said microcomputer.

14. In a sewing machine, a monitor according to claim 12, including a Darlington transistor having a base connected to said first output and a collector connected to said light emitter, said light emitter comprising a light emitting diode.

* * * * *